US012392058B1

(12) United States Patent
Geiwald et al.

(10) Patent No.: US 12,392,058 B1
(45) Date of Patent: Aug. 19, 2025

(54) HEATHER FILAMENT YARNS AND FABRICS, AND METHODS FOR PRODUCING THE SAME

(71) Applicant: Winds Enterprises Limited, China Hong Kong (HK)

(72) Inventors: Paul Urban Geiwald, Encinitas, CA (US); Lean Teik Heng, Shanghai (CN); Yu Chung Lo, San Diego, CA (US)

(73) Assignee: Winds Enterprises Limited, China Hong Kong (HK)

( * ) Notice: Subject to any disclaimer, the term of this patent is extended or adjusted under 35 U.S.C. 154(b) by 39 days.

(21) Appl. No.: 17/684,974

(22) Filed: Mar. 2, 2022

Related U.S. Application Data

(63) Continuation of application No. 15/965,073, filed on Apr. 27, 2018, now abandoned.

(60) Provisional application No. 62/491,153, filed on Apr. 27, 2017.

(51) Int. Cl.

| | |
|---|---|
| ***D02G 3/34*** | (2006.01) |
| ***D02G 1/02*** | (2006.01) |
| ***D02G 3/02*** | (2006.01) |
| ***D04B 1/12*** | (2006.01) |
| ***D04B 1/16*** | (2006.01) |
| ***D04B 21/08*** | (2006.01) |
| ***D04B 21/16*** | (2006.01) |
| ***D04B 21/20*** | (2006.01) |
| ***D06P 3/52*** | (2006.01) |
| *A41D 31/00* | (2019.01) |

(52) U.S. Cl.
CPC ..... *D02G 3/346* (2013.01); *D02G 1/0286* (2013.01); *D02G 3/02* (2013.01); *D04B 1/126* (2013.01); *D04B 1/16* (2013.01); *D04B 21/08* (2013.01); *D04B 21/16* (2013.01); *D04B 21/207* (2013.01); *D06P 3/52* (2013.01); *A41D 31/00* (2013.01); *A41D 2500/10* (2013.01); *D10B 2331/04* (2013.01); *D10B 2501/04* (2013.01)

(58) Field of Classification Search
CPC ..... D02G 1/0286; D02G 3/02; D02G 3/346; D04B 1/126; D04B 1/16; D04B 21/08; D04B 21/16; D04B 21/207; D06P 3/52; A41B 1/08; A41D 31/00; A41D 2500/10; D10B 2331/04; D10B 2501/04
See application file for complete search history.

(56) References Cited

U.S. PATENT DOCUMENTS

| | | | | |
|---|---|---|---|---|
| 3,401,142 | A | 10/1968 | Bowman et al. | |
| 3,412,547 | A | 11/1968 | Martin | |
| 3,414,957 | A * | 12/1968 | Langstaff | D06C 7/02 28/169 |
| 3,468,121 | A | 9/1969 | Katsunosuke | |
| 3,587,220 | A | 6/1971 | Eggleston | |
| 3,593,513 | A | 7/1971 | Reese | |
| 3,604,197 | A | 9/1971 | Sekiguchi et al. | |
| 3,676,906 | A | 7/1972 | Eggleston | |
| 3,681,910 | A | 8/1972 | Reese | |
| 3,829,543 | A | 8/1974 | Robertson | |
| 4,001,171 | A | 1/1977 | Khanna | |
| 4,025,595 | A | 5/1977 | Mirhej | |
| 4,155,214 | A | 5/1979 | Mirhej | |
| 4,222,223 | A | 9/1980 | Nelson | |
| 4,280,261 | A | 7/1981 | Nelson | |
| 4,521,585 | A | 6/1985 | Thomsen et al. | |
| 4,602,046 | A | 7/1986 | Buser et al. | |
| 4,929,698 | A | 5/1990 | Hagewood | |
| 4,933,427 | A | 6/1990 | Charles et al. | |
| 5,188,892 | A | 2/1993 | Grindstaff | |
| 5,234,645 | A | 8/1993 | Grindstaff | |
| 5,308,564 | A | 5/1994 | Grindstaff | |
| 5,613,285 | A | 3/1997 | Chester et al. | |
| 6,354,067 | B2 | 3/2002 | Foil, Jr. | |
| 6,383,635 | B1 | 5/2002 | King et al. | |
| 6,497,952 | B1 | 12/2002 | Ohkoshi et al. | |

(Continued)

FOREIGN PATENT DOCUMENTS

| | | |
|---|---|---|
| EP | 1 627 942 A1 | 2/2006 |
| JP | 2000-282326 A | 10/2000 |

OTHER PUBLICATIONS

Kathryn L. Hatch, Textile Science, 1993, West Publishing Co., pp. 428, 433-437 (Year: 1993).*
Extended European Search Report issued in EP 14183743.5, dated Jan. 26, 2015, 6 pages.

(Continued)

*Primary Examiner* — Shaun R Hurley

(74) *Attorney, Agent, or Firm* — FROST BROWN TODD LLP

(57) ABSTRACT

A heather filament yarn includes first pre-colored filaments comprising first polyester filaments dyed with a first cationic dyestuff, and second pre-colored filaments comprising second polyester filaments dyed with a second cationic dyestuff. A knitted heather fabric includes a plurality of the heather filament yarns knitted together to form the knitted heather fabric. The first and/or second pre-colored filaments may have contrasting colors. A method of manufacturing a heather filament yarn includes preparing a plurality of first pre-colored filaments by dyeing first uncolored filaments using a first cationic dyestuff, preparing a plurality of second pre-colored filaments by separately dyeing second uncolored filaments using a second cationic dyestuff, and twisting the first and second pre-colored filaments together to form the heather filament yarn. The heather filament yarns may then be knitted together to form a heather fabric.

21 Claims, 2 Drawing Sheets

(56) References Cited

U.S. PATENT DOCUMENTS

| | | | | |
|---|---|---|---|---|
| 7,008,694 | B1 * | 3/2006 | Frankel | D06P 1/004 428/364 |
| 7,070,624 | B2 | 7/2006 | Holmes, III et al. | |
| 7,818,982 | B2 | 10/2010 | Prickett | |
| 8,907,009 | B2 | 12/2014 | Otto et al. | |
| 2009/0131628 | A1 * | 5/2009 | Katsuma | D01F 6/84 528/305 |
| 2009/0173055 | A1 | 7/2009 | Silver | |
| 2010/0130083 | A1 * | 5/2010 | Tanaka | C08G 18/0828 525/453 |
| 2011/0086225 | A1 | 4/2011 | Takagi et al. | |
| 2013/0247268 | A1 * | 9/2013 | Niwa | D03D 1/00 428/156 |
| 2015/0068254 | A1 | 3/2015 | Geiwald et al. | |
| 2015/0107214 | A1 | 4/2015 | Rudinger | |
| 2015/0122368 | A1 | 5/2015 | Poon | |
| 2015/0140884 | A1 * | 5/2015 | Mizuma | D06N 3/042 427/412 |
| 2016/0002829 | A1 | 1/2016 | Lightman | |
| 2017/0096772 | A1 * | 4/2017 | Suzuki | D06N 7/00 |
| 2018/0055117 | A1 * | 3/2018 | Bailey | D04B 1/24 |

OTHER PUBLICATIONS

EP Office action dated Nov. 21, 2018, issued in EP 14183743.5, 6 pages.

Unknown, Standard Guide for Heated System Surface Conditions That Produce Contact Burn Injuries, Designation: C 1055-99, Annual Book of ASTM Standards, vol. 04.06, pp. 1-8 (1999).

* cited by examiner

HEATHER FILAMENT YARNS AND FABRICS, AND METHODS FOR PRODUCING THE SAME

CROSS-REFERENCE TO RELATED APPLICATION(S)

This application is a continuation of U.S. patent application Ser. No. 15/965,073 filed Apr. 27, 2018, which claims priority to and the benefit of U.S. Provisional Application Ser. No. 62/491,153 filed on Apr. 27, 2017 and titled BLEED-FREE POLYESTER FILAMENT HEATHER YARNS AND FABRICS FOR USE IN MANUFACTURING OF ARTICLES OF CLOTHING, AND METHOD FOR PRODUCING THE SAME, the entire content of each of which is incorporated herein by reference.

BACKGROUND

Polyester is used extensively across various industries to make all manner of products, from fabrics for apparel and home furnishings to industrial components such as tire reinforcements, safety belts and conveyor belts. Given the widespread uses of polyester across these industries, manufacturing polyester fabrics in various different colors is extremely important.

A relatively recent trend in the fabric and textile industry is the production of heather fabrics, which have a two-tone color effect in which the same fabric blends two different color tones. In polyester heather fabrics, this two-tone effect is generally limited to combinations or blends of two shades or tones of the same color (e.g., a blend of dark green and light green, or a blend of navy blue and light blue, or a blend of charcoal gray and light gray). To achieve this two-tone (same color or hue) effect, first, a dual filament yarn is produced by twisting two different types of polyester filaments to form a single yarn having two different polyester filaments, i.e., cationic dyeable polyester filaments and normal polyester filaments. These twisted filament yarns are then knitted to form the fabric, and the knitted fabric is then dyed in two different dye baths, a process known as "fabric double-dye."

In the fabric double-dye procedure, the knitted fabric is first dyed in a cationic dyestuff, thereby dyeing the cationic dyeable polyester filaments in the knitted fabric. The dyed fabric is then dyed again with a disperse dye to color the normal polyester filaments in the knitted fabric. However, the disperse dye in the second dyeing procedure also colors (or stains) the already dyed cationic dyeable polyester filaments in the fabric. In particular, while cationic dyeable polyester is a polyester that has been modified to create anionic sites suitable for absorbing (or "taking up") cationic dyestuffs, the underlying polyester material maintains certain inherent properties of normal polyester. One of these maintained properties is the absorption (or "taking up") of disperse dyes. As the cationic dyeable polyester filaments in the knitted fabric take up both the cationic dyestuff and the disperse dye during the fabric double-dye procedure, this technique cannot generate heather fabrics with different color hues. Instead, the disperse dye stains the already dyed cationic dyeable polyester filaments, altering the original hue of the cationic dyeable polyester filaments. As such, the fabric double-dye procedure can only produce heather fabrics that blend two tones or shades of the same color.

In addition to the limitations on color combinations, conventionally dyed polyester heather fabrics are generally not suitable or desirable for screen printing. In particular, the disperse dye on the normal polyester filaments is subject to dye sublimation when exposed to high temperatures, such as those encountered during the flashing and curing processes of the screen printing operation. This dye sublimation occurs because the disperse dyestuff does not form a strong ionic bond with the normal polyester filaments. As such, when subjected to high temperatures, the disperse dye molecules gain enough energy to detach from the normal polyester filaments and sublime (i.e., transition directly from solid into gas). After this transition, the gaseous disperse dyestuff sublimated from the normal polyester filaments migrates into the printing ink, changing the color of the ink. For example, a red disperse dyestuff that sublimates and migrates into a white printing ink will turn the white printing ink pink. This dye sublimation and migration phenomenon is known as "bleeding," and is considered unacceptable in the textile industry. As "bleeding" nonetheless occurs during screen printing operations, it is common practice to apply an anti-migration layer and a flashing step prior to printing. However, this makes the printed design (or logo) very thick and stiff.

SUMMARY

According to embodiments of the present disclosure, a heather filament yarn includes first pre-colored filaments comprising first polyester filaments dyed with a first cationic dyestuff, and second pre-colored filaments comprising second polyester filaments dyed with a second cationic dyestuff. The first and second pre-colored filaments are twisted together to form the heather filament yarn. In some embodiments, the heather filament yarn may further include third pre-colored filaments comprising third polyester filaments that are dyed with a third cationic dyestuff. The third pre-colored filaments may be twisted together with the first and second pre-colored filaments to form the heather filament yarn.

In some embodiments, the first pre-colored filaments have a color that is contrasting to a color of the second pre-colored filaments. In other embodiments, the first pre-colored filaments have a color that is a different tone, shade or tint of a color of the second pre-colored filaments.

In some embodiments, a knitted heather fabric may include a plurality of the heather filament yarns knitted together to form the knitted heather fabric. The knitted heather fabric may be 100% polyester. In some embodiments, the knitted heather fabric may include a plurality of the heather filament yarns and at least one Spandex yarn knitted together to form the knitted heather fabric.

According to some embodiments, an article of clothing includes the knitted fabric. In the article of clothing, the first pre-colored filaments may have a color that is contrasting to a color of the second pre-colored filaments. In some embodiments, however, the first pre-colored filaments have a color that is a different tone, shade or tint of a color of the second pre-colored filaments.

In some embodiments, a method of manufacturing a heather filament yarn includes preparing a plurality of first pre-colored filaments by dyeing first uncolored filaments using a first cationic dyestuff, preparing a plurality of second pre-colored filaments by separately dyeing second uncolored filaments using a second cationic dyestuff, and twisting the plurality of first pre-colored filaments together with the plurality of second pre-colored filaments to form the heather filament yarn. The method may further include separately dyeing a plurality of third pre-colored filaments using a third cationic dyestuff, and the twisting may include twisting the first pre-colored filaments and the second pre-colored filaments with the third pre-colored filaments to form the heather filament yarn. In some embodiments, dyeing the plurality of first pre-colored filaments and separately dyeing the plurality of second pre-colored filaments each includes combining a plurality of uncolored polyester filaments with water to form a filament bath, adding the first or second cationic dyestuff to the filament bath to form a dye bath, heating the dye bath to facilitate dyeing, and removing the water from the dye bath to yield the plurality of first pre-colored filaments or the plurality of second pre-colored filaments.

According to some embodiments, a method of making a knitted heather fabric includes preparing a plurality of the heather filament yarns, and knitting the plurality of heather filament yarns together to form the knitted heather fabric.

BRIEF DESCRIPTION OF THE DRAWINGS

These and other features and advantages of embodiments of the present disclosure will be better understood with reference to the following detailed description when considered in conjunction with the accompanying drawings, in which.

DETAILED DESCRIPTION

Figure 1:
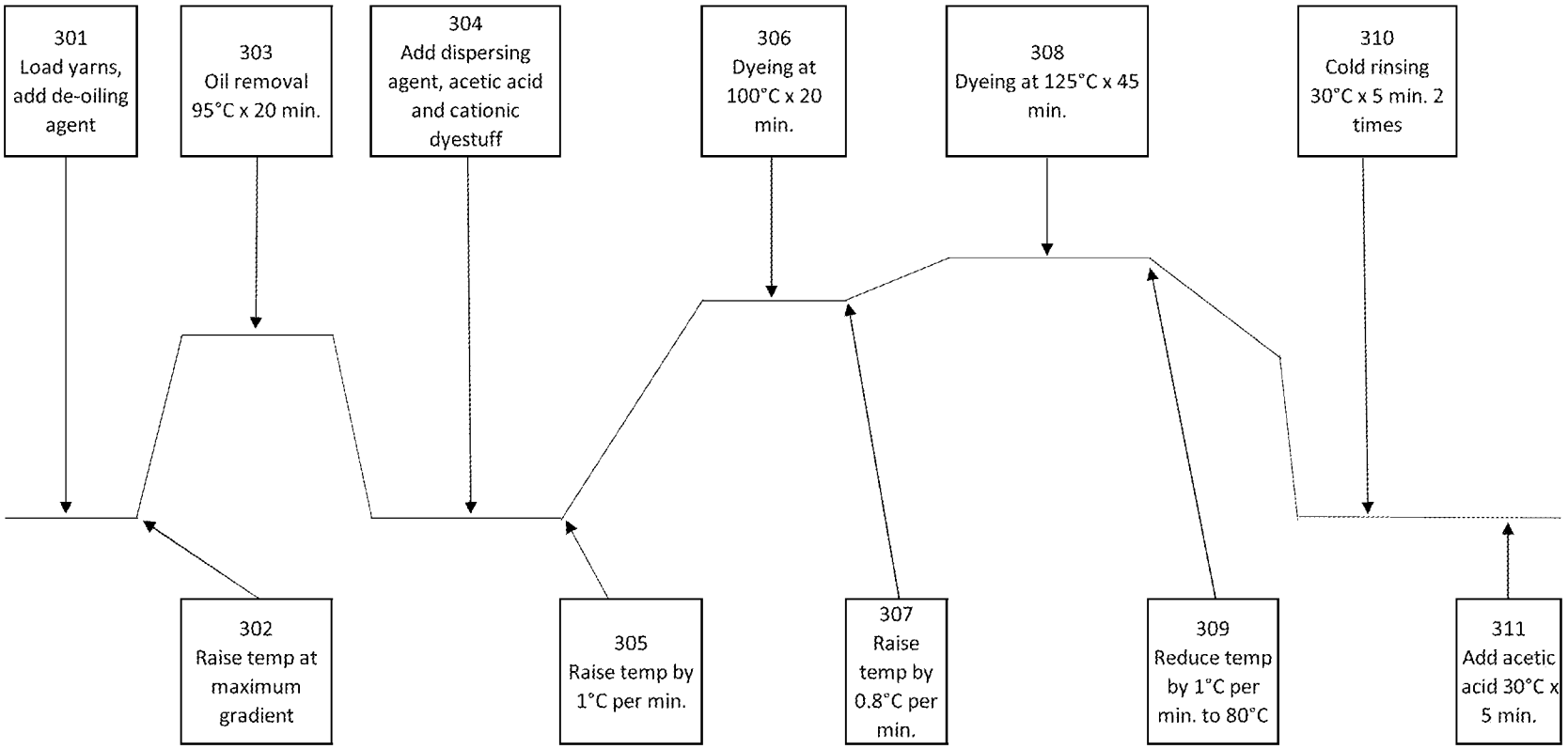
FIG. 1 is a flow chart illustrating a method of dyeing polyester filaments according to embodiments of the present disclosure.

Conventional polyester filament heather fabrics are manufactured by first knitting together yarns in a knit pattern. To enable the knitted fabric to take on two color tones or shades, the yarns in the fabric are made by blending (or twisting together) two different types of polyester filaments, i.e., normal (or unmodified) polyester filaments and cationic dyeable polyester filaments. The knitted fabric is then dyed as a single piece in two different baths of dye solution, a process dubbed "fabric double-dye." The first bath of dye solution typically includes a cationic dyestuff that is absorbed (or "taken up") by the cationic dyeable polyester filaments in the knitted fabric, and the second bath typically includes a disperse dyestuff that is absorbed (or "taken up") by the normal polyester filaments.

As the normal polyester filaments do not absorb (or "take up") the cationic dyestuff, the normal polyester filaments and the cationic dyeable polyester filaments in the knitted fabric can theoretically take on different color tones or shades. However, while the normal polyester filaments do not absorb the cationic dyestuff, the cationic dyeable polyester filaments do absorb (or "take up") the disperse dyestuff. As such, the conventional fabric double-dye technique can only result in heather fabrics having two tones or shades of the same color or hue (e.g., dark green and light green, or navy blue and light blue), and cannot produce heather fabrics with two different hues (e.g., red and green, or red and yellow, or red and blue, or green and yellow, or green and blue, or yellow and blue).

In addition to the limitations on color combinations, the conventional fabric double-dye technique has other drawbacks. First, as this technique dyes the fabric after knitting, each of the dye baths requires a significant amount of water in order to properly saturate the fabric with each dye solution. Second, because the heather fabric is dyed after knitting, heather effects of only two different color tones or shades can be achieved (i.e., the tone or shade of the cationic dyeable polyester filaments, and the tone or shade of the normal polyester filaments).

According to embodiments of the present disclosure, a filament heather yarn (also referred to herein, interchangeably, as a "heather filament yarn," "polyester filament heather yarn," "a twisted heather yarn," a "twisted polyester filament heather yarn," "a twisted filament yarn," a "polyester heather yarn," and like terms) includes first pre-colored filaments comprising first cationic dyeable (or dyed) polyester filaments, and second pre-colored filaments comprising second cationic dyeable (or dyed) polyester filaments. Both the first and second cationic dyeable (or dyed) polyester filaments are dyed with a cationic dyestuff. The first and second pre-colored filaments are twisted together to form the heather filament yarn (or twisted heather filament yarn). In some embodiments, the heather filament yarn may further include third pre-colored filaments, which include third cationic dyeable (or dyed) polyester filaments that are also dyed with a cationic dyestuff. The third pre-colored filaments are twisted together with the first and second pre-colored filaments to form the filament heather yarn. It is understood, however, that the filament heather yarns according to embodiments of the present disclosure can include any number of different pre-colored filaments. As such, although first, second and third pre-colored filaments are mentioned here, any number of more than three different pre-colored filaments may be used to create a filament heather yarn including multiple colors (e.g., 2 or more, or 3 or more colors). When the filament heather yarn is made from 3 or more pre-colored filaments, the third, fourth, etc. pre-colored filaments may also be pre-colored or dyed with a cationic dyestuff.

Additionally, each of the first, second and/or third (or more) pre-colored filaments may have any suitable size, and the different pre-colored filaments may have the same size or different sizes depending on the desired heather color effect. For example, in some embodiments, the first and second (and/or third or more) pre-colored filaments may all have the same filament size. In these embodiments, each of the colors imparted by the pre-colored filaments are present in equal amounts in the heather fabric, and contribute equally to the heather coloring effect. However, in some embodiments, the differently colored pre-colored filaments may have different filament sizes, resulting in an unequal distribution of the different colors in the heather fabric, meaning that the colors imparted by the different pre-colored filaments contribute unequally to the heather coloring effect. The filament sizes and combinations of filaments sizes are not limited, however, as an example of the effects described here, to form a two-colored (i.e., red and yellow for the purposes of this example) heather filament yarn, a 50 D (50 denier) red (or first color) filament yarn can be twisted together with a 50 D yellow (or second color) filament yarn to form a 100 D heather filament yarn having 50% red color (or first color) and 50% yellow color (or second color). However, if a greater amount of one of the colors is desired (e.g., more yellow than red, or more red than yellow in the current example), the two filaments can have different sizes. For example, a 50 D red (or yellow) filament and a 75 D yellow (or red) filament can be twisted together to form a 125 D twisted yarn having 40% red (or yellow) color and 60% yellow (or red) color.

This sizing concept applies to twisted filament yarns having any number of different filaments (or colors). Indeed, as an another illustrative (and non-limiting) example, to form multi-colored (three-colored for purposes of this example) heather yarn, a 50 D red color (or first color) filament yarn may be twisted with a 50 D navy color (or second color) filament yarn and a 50 D green color (or third color) filament yarn to form a 150 D heather filament yarn that includes red, navy and green colors all in the same proportions (i.e., 33.33%). In some embodiments, however, one or more of the three different filaments may have a different size from one or more of the other filaments in order to create different coloring effects (i.e., to include certain colors in differing amounts in the heather fabric). As an example of this size variation in a three-colored yarn, a 50 D red color (or first color) filament yarn may be twisted with a 75 D yellow color (or second color) filament yarn and a 50 D blue color (or third color) filament yarn to form a 175 D heather yarn that include 28.57% of the red color (or first color), 42.86% of the yellow color (or second color) and 28.57% of the blue color (or third color). Such multi-colored and contrasting heather effects cannot be achieved by existing heather filament fabrics because those conventional fabrics blend cationic polyester filaments with normal polyester filaments, and each of these types of filaments can only absorb (or "take up") up one color using the conventional fabric double-dye method.

In some embodiments of the present disclosure, a polyester filament heather yarn and/or fabric (also referred to herein interchangeably as a "polyester heather yarn") includes a blend of at least first pre-colored polyester filaments and second pre-colored polyester filaments. In some embodiments, the first and second pre-colored polyester filaments are both dyed with a cationic dyestuff. This blend of polyester filaments dyed using cationic dyestuffs enables the production of polyester heather fabrics that avoid (or reduce) dye sublimation issues common in conventional polyester heather products currently on the market.

Additionally, as the polyester filaments are pre-colored (i.e., dyed prior to twisting or knitting), the polyester filament heather yarns according to embodiments of the present disclosure can include two or more different hues, basic colors or color families, and not just two different tones, tints or shades of the same basic color or color family. However, again because the polyester filaments are pre-colored, the polyester filament heather yarns according to embodiments of the present disclosures can also include two or more different tones, tints or shades of the same basic color or color family. For example, in some embodiments, the filament polyester heather yarn may include first pre-colored filaments having a first color, and second pre-colored filaments having a second color that is a different color than the first color of the first pre-colored filaments. In some embodiments, however, the filament polyester heather yarn may include first pre-colored filaments having a first hue, and second pre-colored filaments having a second hue that is a different hue than the first hue of the first pre-colored filaments. Additionally, in some embodiments, the filament polyester heather yarn may include first pre-colored filaments having a first basic color or first color within a first color family, and second pre-colored filaments having a second basic color or a second color within a second color family, and the first basic color or first color family may be different from the second basic color or color family.

As used herein, the term "color" is used generically to denote the color, hue, shade, tint or tone of an object (e.g., a filament, yarn or fabric). As such, the term "different color," as used herein to describe the differences between the first and second pre-colored filaments (according to certain embodiments of the present disclosure) refers to any difference in color, shade, tone, tint or hue. However, the terms "basic color," "color family" and like terms, are used to denote a primary (or secondary) color, i.e., one of blue, green, red, yellow or green. As an example of the use of these terms, red is a "basic color," while burgundy is a "color" within the red "color family." Additionally, the term "hue" is used herein to denote the dominant "basic color" or "color family" of the "color" being identified. As an example of the use of this term, burgundy and pink are both "colors" having a red "hue" since red is the dominant "basic color" or "color family." Similarly, indigo and sapphire are both "colors" having a blue "hue" since blue is the dominant "basic color" or "color family." Further, as used herein, the terms "tint," "shade," and "tone" refer to lighter or darker versions of the underlying "basic color" or "hue." More specifically, "tint" refers to a lighter version of the underlying "basic color" or "hue" and is typically produced by adding any amount of white color to the underlying "basic color" or "hue." "Tone" also refers to a lighter version of the underlying "basic color" or "hue," but is typically produced by adding any amount of gray color to the underlying "basic color" or "hue." Finally, "shade" refers to a darker version of the underlying "basic color" or "hue," and is typically produced by adding any amount of black color to the underlying "basic color" or "hue."

As an example of this terminology in connection with embodiments of the present disclosure, in an example embodiment in which the polyester filament heather yarn may include first and second pre-colored filaments having different first and second colors (respectively), the first "color" may be indigo and the second "color" may be sapphire. As indicated by this example, the first and second pre-colored filaments can have first and second "colors" within the same "color family," i.e., the first and second "colors" may be different "shades," "tones" or "tints" of the same "basic color" or "color family" (in this example, the blue "basic color" or "color family").

As a second example of this terminology, in an example embodiment in which the polyester filament heather yarn may include first and second pre-colored filaments having different first and second hues (respectively), the first "hue" may be a blue hue and the second "hue" may be a green hue. It is important to note that many "colors" may have a blue (or red, green or yellow) "hue" but also include elements of green (or red, blue or yellow). As such, in this example, while the first "hue" may be blue and the second "hue" may be green, the first and second pre-colored filaments may have colors that are similar (though still different), e.g., a first color of cerulean (with a blue dominance or hue) and a second color of teal (with a green dominance or hue).

In another example of this terminology, in an example embodiment in which the polyester filament heather yarn may include first and second pre-colored filaments having different first and second "basic colors" or "color families" (respectively), the first "basic color" or "color family" may be blue and the second "basic color" or "color family" may be red. It is important to note that each "color family" may have different shades, tints or tones of the underlying basic color (e.g., different shades, tints or tones of red). However, in this example, the first and second pre-colored filaments do not have a slight variation in shade, tone or tint, but rather have different "basic colors" or "color families," (e.g., one red, and one blue). As can be seen from this example, then, the heather filament yarns according to embodiments of the present invention can have a contrasting heather effect, i.e., the first and second "basic colors" or "color families" are different, thereby creating a contrast in color, and not just a variation in shade, tone or tint. As further examples of this contrasting effect, if the first pre-colored filaments have a red color, the second pre-colored filaments may have a yellow, green or blue color, and if the first pre-colored filaments have a blue color, the second pre-colored filaments can be a red, green or yellow color, etc.

Additionally, conventional polyester heather fabrics require two different types of polyester (i.e., cationic dyeable polyester and normal polyester) to be blended (or twisted) together in order to achieve the heather coloring effect. In particular, because conventional polyester heather fabrics are dyed after knitting into a fabric, they rely on the different dye uptake behaviors of cationic dyeable polyester and normal polyester to achieve the heather effect. As such, these conventional polyester fabrics cannot be made with a heather color effect unless both cationic dyeable polyester and normal polyester are included in the fabric. In contrast, according to embodiments of the present invention, the polyester heather fabric may include only filaments of the same type of polyester, e.g., cationic dyeable polyester. For example, according to embodiments of the present disclosure, a heather fabric or textile can be 100% cationic dyeable polyester while also having a heather coloring effect. Indeed, because the heather fabrics according to embodiments of the present invention include pre-colored polyester filaments that are knitted after dyeing, all filaments used in the heather fabric can be the same type of polyester (e.g., cationic dyeable polyester).

Contrary to conventional heather fabrics, the heather fabrics according to embodiments of the present disclosure can also include more than two different colors contributing to the heather effect, and can include contrasting colors. Specifically, because the heather fabrics are knitted from pre-colored polyester filaments, the fabrics can be knitted using any number of differently colored filaments, including, e.g., filaments that have contrasting colors.

As used herein, the term "pre-colored" refers to the coloring or dyeing of the polyester filaments before the filaments are twisted into a twisted filament heather yarn or knitted into a fabric or textile. Accordingly, the "pre-colored" polyester filaments discussed herein are dyed or colored while in the filament form, and are twisted into a heather yarn and then knitted into a textile or fabric after the coloring or dyeing procedure. This enables the production of filament heather yarns and heather fabrics or textiles having more than two colors contributing to the heather effect. Indeed, because the filaments are colored before twisting into heather yarns and knitting into fabrics, the end yarns and fabrics may have any number of different colors contributing to the heather effect, including 3 or more colors.

According to embodiments of the present disclosure, a heather yarn may be formed by blending (or twisting) the first cationic dyeable polyester filaments dyed by a first cationic dyestuff, and second cationic dyeable polyester filaments dyed by a second cationic dyestuff. Similarly, in some embodiments, a heather fabric may be formed by kitting the heather yarns, or by twisting and knitting the first and second polyester filaments together. The first and second polyester filaments dyed by a cationic dyestuff may be any desired color, including black and all other colors.

In the heather yarns and/or fabrics according to embodiments of the present disclosure, the cationic dyestuffs used to color the first and second filaments form strong ionic bonds with cationic dyeable polyester materials. These strong ionic bonds create a colorfast textile that is substantially bleed-free even after high temperature exposure. For example, the heather fabrics according to embodiments of the present disclosure achieve grade 4.5 in each of color fastness to dry heat (American Association of Textile Chemists and Colorists, "AATCC" 117), color fastness to washing (AATCC 61-2A), and color fastness to dye transfer (AATCC 160). The first and second filaments also generally do not sublimate under high temperatures, such as those encountered during a screen printing operation (e.g., 300° F. to 340° F.).

In addition, according to embodiments of the present disclosure, heather fabrics can achieve the desired color using significantly less water than conventionally required for currently available heather textiles. In particular, as discussed above, conventional heather filament fabrics are prepared by knitting together yarns made of different filaments (e.g., cationic dyeable polyester filaments and normal polyester filaments) in a knit pattern to form a completed textile or fabric. This knitted fabric is then dyed as a single piece in two different baths of dye solution. Each of these baths of dye solution contains the dye material and other additives, but is mostly water. In significant contrast, according to embodiments of the present disclosure, the first and second filaments are dyed prior to twisting the first and second filaments together to form the twisted filament heather yarn, and prior to knitting or weaving the yarns into a fabric or textile. Indeed, the first and second filaments (and not the finished textile) are submerged in a dye bath. This saves a significant amount of water compared to the conventional textile dyeing process because the filament dyeing process according to embodiments of the present disclosure only requires a filament/liquid ratio of about 1:6.0 to about 1:7.0, or about 1:6.5. This means that for each 1 kilogram of filaments, only about 6.0 to about 7.0, or about 6 to about 7 kilograms of liquid (which is mostly water, but also includes the dyestuff, and other chemical agents and/or additives for facilitating dye uptake) is needed to effect sufficient dye uptake and coloring. However, the conventional dyeing method (in which the fabric or textile is submerged in the bath as a single piece) requires a fabric/bath ratio of 1:10 to 1:20. This means that to dye the same weight of fabric (e.g., 1 kilogram), the conventional method requires 10 to 20 kilograms of bath liquid rather than the about 6.0 to about 7.0, or about 6.5 kilograms used in embodiments of the present disclosure.

As can be seen from this comparison, the dyeing methods according to embodiments of the present disclosure use only a portion of the water required the conventional technique, e.g., the dyeing methods according embodiments of the present disclosure use only about 30% (6/20) to about 70% (7/10), about 32.5% (6.5/20) to about 70%, about 32.5% to about 65%, or about 35% to about 65% of the water required in the conventional technique. In some embodiments, for example, the dyeing methods according to embodiments of the present disclosure use only about 30%, about 32.5%, about 35%, about 60%, about 65%, or about 70% of the water required by the conventional process. This means that the dyeing methods according to embodiments of the present disclosure achieve a water savings compared to the conventional process of about 30% to about 70%, about 30% to about 67.5%, about 35% to about 67.5%, or about 35% to about 65%.

However, as discussed further below, because the dyeing methods according to embodiments of the present disclosure separately dye the filaments themselves (i.e., prior to twisting and knitting), the filaments only need to be dyed once. As such, to produce the same knitted fabric with a heather effect, the conventional process requires two dye baths with a liquid amount based on the total weight of the fabric, while the methods according to the present disclosure require the equivalent of one bath with a liquid amount based on the weight of the fabric (i.e., the weight of the filaments). Consequently, while the conventional method requires two baths, each including 10 to 20 kilograms of liquid to dye a 1 kilogram fabric (for a total of 20 to 40 kilograms of liquid dye per kilogram of fabric), the methods according to the present disclosure use only about 3.0 to about 3.5 kilograms of liquid, or about 3.25 kilograms of liquid, per bath (per type of filament), for a total of about 6.0 to about 7.0 kilograms of liquid total for all filaments in embodiments including first and second filaments). This represents an even more significant water savings compared to the conventional technique of about 65% to about 85%, about 67.5% to about 83.75%, or about 70% to about 82.5%. In some embodiments, for example, the dyeing methods according to the present disclosure may achieve water savings compared to the conventional methods of about 65%, about 6.5%, about 70%, about 82.5%, about 83.75%, or about 85%.

According to embodiments of the present disclosure, a method of making a heather fabric or textile utilizes the water-saving, colorfast benefits of cationic dyeing of filaments, and the versatility of a filament pre-dyeing process. The unique blending (or twisting) of first and second pre-colored polyester filaments dyed by cationic dyestuffs provides a substantially bleed-free fabric or textile that is useful in the production of articles of clothing suitable for screen printing. As used herein, the term "substantially" is used as a term of approximation, and not as a term of degree, and is intended to account for the inherent deviations and variations in measured, observed or calculated properties or values. Accordingly, the term "substantially bleed-free" denotes that the fabric or textile would be considered bleed-free by those of ordinary skill in the art performing a screen printing operation and observing any color bleeding with the naked eye, even if, for example, the screen printed image (e.g., logo) may include some level of color bleeding when measured using a measurement instrument or observed under a microscope.

A method of manufacturing a filament heather yarn according to embodiments of the present disclosure includes preparing first pre-colored filament(s) by dyeing first uncolored cationic dyeable polyester filament(s) with a first cationic dyestuff, separately preparing second pre-colored filament(s) by dyeing second uncolored cationic dyeable polyester filament(s) with a second cationic dyestuff, and twisting the first pre-colored filament(s) together with the second pre-colored filament(s) to form the twisted filament heather yarn. The method may further include preparing third pre-colored filament(s) by dying third uncolored cationic dyeable polyester filament(s) with a third cationic dyestuff. In embodiments with third pre-colored filament(s), the twisting includes twisting the first pre-colored filament (s) and the second pre-colored filament(s) with the third pre-colored filament(s) to form a twisted filament heather yarn having three or more colors.

Preparing the plurality of first, second and/or third (or more) pre-colored filament(s) may include separately combining the first, second or third uncolored filament(s) with water to form a respective filament bath, adding the first, second or third cationic dyestuff to the respective filament bath to form a dye bath, heating the dye bath, and removing the water from the dye bath to yield the first, second and/or third (or more) pre-colored filament(s). In particular, the first, second and/or third filament(s) are each separately dyed via a bath dye process in which uncolored filaments are submerged in a bath containing a cationic dyestuff.

Unlike conventional processes for achieving the heather color effect which dyes the fabric after knitting, according to embodiments of the present disclosure, the first, second and/or third (or more) filament(s) are dyed before twisting or knitting them together. As such, while the dyeing process for each of the first, second and/or third (or more) filament(s) according to embodiments of the present disclosure relies on a bath dye process using a cationic dye, the filament(s) are dyed in filament form prior to twisting into a yarn or knitting into a fabric. This process significantly reduces the amount of water needed to dye the resulting textile or fabric, and enables the creation of heather effects with 3 or more colors.

To produce the first, second and/or third (or more) pre-colored polyester filaments, raw cationic dyeable polyester filament(s) are dyed in different colors. Then, the first, second and/or third (or more) pre-colored polyester filament (s) are blended (or twisted) to form twisted filament heather yarns having the desired tonal, contrasting or multiple color heather effect. The twisted filament heather yarns are then knitted to form a heather fabric. In some embodiments, spandex yarn can be incorporated in the fabric during the knitting process to give the fabric extra elongation and recovery performance. The fabric may then be rinsed and de-oiled to remove contaminants and oil obtained during the yarn twisting and knitting processes. Chemical agents may be added to the fabric during the finishing process to achieve certain desired performance characteristics. Non-limiting examples of suitable such chemical agents include wicking agents, anti-odor agents, ultra-violet protection agents, anti-microbial agents, anti-static agents, soil release agents, water repellent agents, cooling agents, etc.

Any suitable raw cationic dyeable polyester filament(s) may be used to form the first, second and/or third (or more) pre-colored polyester filament(s). In some embodiments, for example, in order to achieve a color that is rich and dark (e.g., having a CMC L value of 18 or below), the raw cationic dyeable polyester filament(s) may contain no less than 2.3% of $SO_3^-$ content by weight. The higher the percentage of $SO_3^-$ content in the filaments, the more anionic dye sites there are to help attach more cationic dyestuff molecules, thereby achieving a richer and darker color tone. This richness of tone can be important in heather fabrics and textiles, particularly when creating heather effects with contrasting colors, because when filament(s) of different colors are twisted together to create the heather effect, the individual colors become somewhat muted or diluted.

As shown in FIG. 1, according to embodiments of the present disclosure, to dye the first, second and/or third (or more) filament(s) (also referred to herein as simply "filament(s)"), first wound cones of raw cationic dyeable polyester filaments are unwound from the cone and rewound onto a perforated cone (e.g., a perforated plastic cone). As the raw cationic dyeable polyester filaments are typically wound tightly and compactly onto a cone for storage, packaging and/or transport, which makes uniform dyeing of the filaments wound on the cone rather difficult. Specifically, as the filaments are wound so tightly and compactly on the cone, it is difficult for the dyestuff in the dye bath penetrate through the many windings (or layers) of filaments on the cone. According to some embodiments, therefore, the raw filaments are unwound from the original cone, and more loosely rewound (e.g., wound under lower tension) on a perforated cone in order to facilitate uniform and homogeneous dye absorption (or uptake), a process dubbed "soft package winding." This soft package winding not only helps achieve uniform and homogeneous dye uptake during the filament dyeing process, but also helps prevent (or reduce) filament breakage. In particular, when placed in the dye bath, the polyester filaments shrink to a large degree during dye uptake. If the filaments are tightly wound (e.g., wound under higher tension), the shrinkage that occurs during dye uptake may cause the filaments to break, especially if the filaments are smaller in size (e.g., yarns of 50 D or smaller, or individual filaments of 1 denier or below). If such breakage occurs, the broken ends of the filaments will protrude from the surface of the filaments, resulting in an uneven hairy appearance and texture, which is undesirable. Additionally, broken filaments can cause inferior yarn strength, resulting in twisted yarns or knitted fabrics of inferior quality and/or bursting strength.

Any suitable perforated cone can be used according to embodiments of the present disclosure. However, according to some embodiments, the perforated cone should be selected to accommodate the high level of shrinkage experienced during dye uptake, and to avoid (or minimize) filament breakage.

After soft winding the filament(s) on the perforated cone, the soft wound perforated cones are weighed to ensure that the weight of the filaments (or cones) and the weight of the water used to dye the filaments satisfies an appropriate ratio. For example, as discussed above, the weight ratio of the filaments to the water may be about 1:6.0 to about 1:7.0, for example, about 1:6.5. The wound cones are then loaded into a package dyeing machine.

Once the filaments (or cones) are inside the dyeing machine, water is filled into the machine until it reaches the desired filament to liquid ratio, e.g., about 1:6.0 to about 1:7.0, for example, or about 1:6.5. A non-ionic de-oiling agent may then be added to the machine (301) in a ratio of about 2 grams per liter of water. The non-ionic de-oiling agent removes excess oil from the filaments which may have been obtained during the filament extrusion, drawing and/or texturing process. In some embodiments, the de-oiling agent may reduce the amount of oil in the filaments to about 0.05 to about 0.1% by weight. Elimination (or reduction) of excess oil helps facilitate dye uptake during the dyeing process.

The dyeing process may begin by increasing the temperature of the bath (i.e., the combination of the filaments and the water in the selected weight ratio) from room temperature to a temperature above the glass transition temperature (Tg) of the cationic dyeable polyester material of the filaments (302). In some embodiments, the Tg of the cationic dyeable polyester material may be about 70° C. to about 85° C., and the temperature of the bath may be increased to about 95° C. at the maximum gradient achievable by the dyeing machine. As used herein, "increasing the temperature at a maximum gradient" and like descriptions refer to increasing the temperature of the bath to the desired temperature over the shortest time period achievable by the dyeing machine. The machine is then allowed to run for about 20 minutes, to complete the de-oiling process (303).

Then, the water is drained and re-filled to the same weight ratio used in the de-oiling process, e.g., about 1:6.0 to about 1:7.0, or about 1:6.5. A dispersing agent may then be added as well as the desired cationic dyestuff and a pH adjusting agent (e.g., acetic acid) (304). The dispersing agent may be added to the bath in any suitable amount, for example, about 2 grams per liter. The dispersing agent may be any suitable dispersing agent used in cationic polyester dyeing procedures. Similarly, the cationic dyestuff may be any cationic dyestuff suitable for dyeing cationic polyester filaments. Those of ordinary skill in the art would be readily capable of selecting a suitable dispersing agent and cationic dyestuff for this process based on the desired color of the filaments. The pH adjusting agent (e.g., acetic acid) is added in order to maintain the pH of the dye bath between about 4.5 and 5.5, in order to facilitate suitable or optimal conditions for dye uptake. The temperature of the machine is then increased at the maximum gradient achievable by the machine (for example at a rate of about 0.7° C. to about 1.3° C. per minute, or about 1° C. per minute) until it reaches 100° C. in order to structurally open the filaments above their glass transition temperature (Tg), thereby exposing the maximum number of dye sites for dye uptake (305). The machine is then run for about 20 minutes (306). Then the temperature of the machine is further increased to about 125° C. at a steady rate of about 0.5° C. per minute to about 1° C. per minute, for example, about 0.8° C. per minute (307). Once the temperature reaches about 125° C., the machine runs for another period of time of about 45 minutes (308). Then the temperature is reduced by about 1.0° C. per minute, until the temperature reduces to a temperature below the Tg of the filaments, for example, a temperature of about 80° C. (309). The filaments regain their closed structure, thus trapping the dyestuffs inside the filaments. The bath liquid is then drained, and the dyeing process completed.

The machine may then be re-filled with water (to the same ratio as used in the de-oiling and dyeing processes) at a temperature of about 25° C. to about 35° C., for example about 30° C. to being a cool rinsing process. The machine runs for about 3 minutes to about 10 minutes, for example about 5 minutes (310), before the water is drained. This rinsing cycle may be repeated as desired (310).

Then the machine is once again re-filled with water (to the same ratio as used in the de-oiling and dyeing processes) at a temperature of about 25° C. to about 35° C., for example about 30° C., and a pH adjusting agent (e.g., acetic acid) is added to adjust the pH to about 5.5 to about 6.0. The machine may then run for another period of time sufficient to effect pH adjustment, for example about 5 to about 7 minutes, or about 5 minutes (311).

Conventional heather polyester fabrics available on the market are colored by dyeing greige fabrics after the knitting process using the fabric double-dye process. Specifically, to achieve a two-tone heather effect, the fabric double-dye process requires dyeing of a fabric including two different types of filaments in two different dye baths (because the two different types of filaments "take up" different types of dyestuffs). In this process, the first dye bath includes a cationic dyestuff to color the cationic dyeable filaments in the fabric, and the second dye bath includes a disperse dye to color the normal polyester filaments in the fabric. However, when the fabric is submerged in the second dye bath, the disperse dye not only colors the normal polyester filaments, but also stains the cationic dyeable polyester filaments, as discussed above. As the disperse dye also stains the cationic dyeable polyester filaments, if the color of the normal polyester filaments (dyed by the disperse dye bath) is darker or deeper than the color of the cationic dyeable polyester filaments (from the first dye bath), this staining will alter the shade or tone of the cationic dyeable polyester filaments in the fabric. Accordingly, when using the conventional fabric double-dye process, the different colors achievable on the different filaments of the fabric are limited to those that are similar in color depth. This limitation in color differences prevents the conventional fabric double-dye process from achieving heather color effects in which the different filaments have contrasting colors, e.g., red and blue, or blue and yellow, etc. In contrast, in embodiments of the present disclosure, the first, second and/or third (or more) filament(s) are colored separately, prior to twisting or knitting. As such, there is no limitation on the colors of the different filaments in the fabric, and as the different colors are achieved by separately dyeing the filaments, no staining of one filament with the dye of another filament occurs.

Additionally, according to embodiments of the present disclosure, the filaments themselves are colored prior to the twisting and knitting processes, yielding significant water savings in the dyeing process, and enabling the manufacture of heather effects with three or more colors. For example, as noted above, the conventional process of dyeing already knitted fabrics or textiles is normally carried out in an overflow jet dyeing machine which requires a liquid ratio of 1:10 to 1:20. This means that every 1 kilogram of fabric requires 10 to 20 kilograms of water for the dyeing process. However, according to embodiments of the present disclosure, the filament dyeing method requires a drastically reduced amount of water. For example, according to embodiments of the present disclosure, the filament dyeing method requires a filament to liquid weight ratio of about 1:6.0 to about 1:7.0, or about 1:6.5. This means that every 1 kilogram of filaments only requires about 6.0 to about 7.0, or about 6.5 kilograms of water for the dyeing process. Accordingly, in some embodiments of the present disclosure, the dyeing process uses 30% to 70%, or 32.5% to 70%, or 32.5% to 65%, or 35% to 65% of the water required by the fabric double-dye method to dye the same weight of fabric. This translates to a water savings of 30% to 70%, or 30% to 67.5%, or 35% to 67.5%, or 35% to 65%. As such, according to embodiments of the present disclosure, in addition to being capable of creating heather effects with 2 or more, or 3 or more colors, the fabric dyeing process is also more environmentally friendly.

Additionally, the conventional fabric double-dye procedure requires two different dye baths to dye a single fabric piece to include a heather color effect. As each bath requires a liquid ratio of 1:10 to 1:20, as discussed above, the entire dying procedure requires a liquid ratio of 1:20 to 1:40. In contrast, according to embodiments of the present disclosure, the filaments are dyed prior to twisting and knitting, and the differently colored filaments are dyed separately. As such, the amount of water needed to color 1 kilogram of fabric according to embodiments of the present disclosure remains 1:6.0 to about 1:7.0, or about 1:6.5. Therefore, comparing two heather fabrics having the same knitting structure and weight, the amount of water required by a method according to embodiments of the present disclosure in which the filament/liquid ratio is 1:6.5 is only about 16.25% to about 32.5% of that that required by the conventional method (depending on the liquid ratio used in both processes). This represents a marked water savings of about 67.5% to about 83.75%.

According to embodiments of the present disclosure, once the filament dyeing process is complete, the filaments (or cones) may be taken out of the dyeing machine and loaded into a hydro-extractor. The hydro-extractor rotates at 1,600 revolutions per minute for around 11 to 13 minutes, for example 12 minutes to remove excess water from the filaments. The water content of the filaments may be controlled to between 15 and 18% by weight. The dyed cationic filaments (or cones) are then taken out of hydro-extractor and placed into a steam dryer for 2.5 to 3 hours (depending on the water content of the filaments), where the filaments are dried at a temperature of about 100° C. to about 105° C. The higher the water content of the filaments, the longer the drying time. Once the outlet temperature of the steam dryer reaches about 95° C., the filaments are considered dry. The steam dried cationic dyed filaments (or cones) are then loaded into a trolley for color checking and testing of color fastness properties prior to the subsequent yarn formation process.

Figure 2:
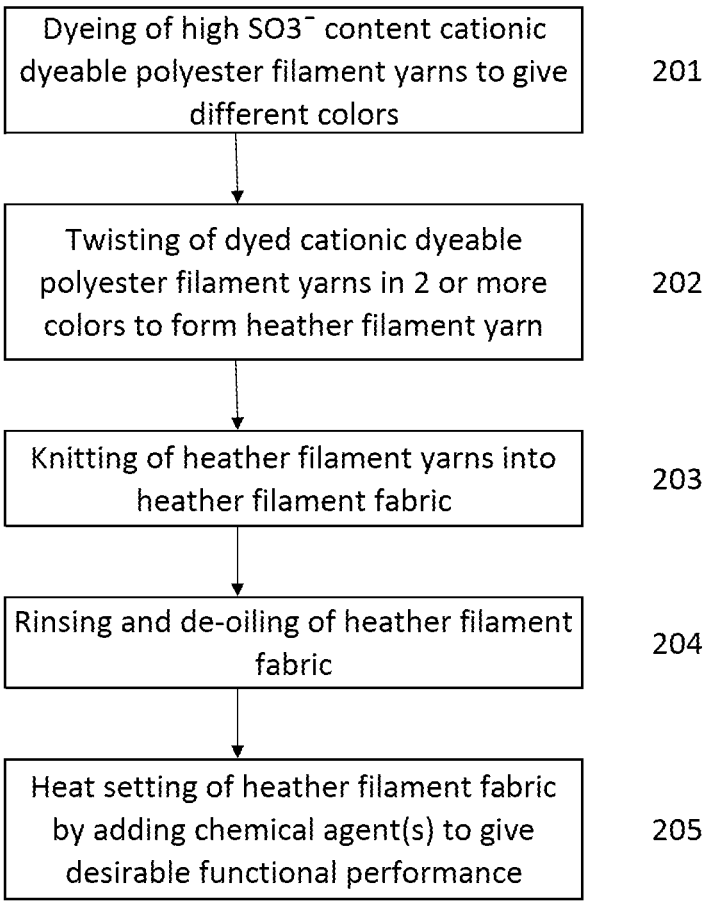
FIG. 2 is a flow chart illustrating a method of making a polyester heather fabric according to embodiments of the present disclosure.

According to some embodiments, when the cationic dyed filaments are ready, a heather yarn can be produced. FIG. 2 depicts an example method of making twisted heather yarns and knitted heather fabrics. As shown in FIG. 2, the first, second and/or third (or more) dyed filaments (201) may go through a filament texturing process in which the differently colored filaments are twisted together to form a twisted filament heather yarn (202). In embodiments using two different colors of filament yarns to form a twisted filament heather yarn, the two filaments may be fed through an air texturing machine in which the filaments are forced through an air tunnel using compressed air. Compressed air with a pressure that varies from about 0.8 kg to about 4.0 kg is blown onto the filaments inside the tunnel to create entanglement between the two filaments, thereby causing them to "twist" together to form one twisted filament yarn (202). As a non-limiting example of this procedure, a 50 D red color (or first color) cationic polyester filament may be fed through the air texturing machine together with a 50 D green color (or second) cationic polyester filament. The two filaments (red and green) will be "twisted" inside the air tunnel to form a 100 D heather filament yarn with 50% red color and 50% green color. The higher the air pressure applied, the tighter the twist in the yarn. Differences in the air pressure applied may also result in differences in the appearance or pattern of the heather.

As discussed above, according to embodiments of the present disclosure, different percentages or proportions of color can be achieved by varying the sizes of the filaments used to create the twisted heather yarns. As a non-limiting example of this concept, a 50 D red color (or first color) cationic polyester filament may be fed through the air texturing machine together with a 100 D green color (or second color) cationic polyester filament, thereby creating a 150 D heather yarn that has 33.3% red color (or first color) and 67.7% green color (or second color). Additionally, as also discussed above, according to embodiments of the present disclosure, twisted heather yarns having more than two colors can also be prepared. According to embodiments of present disclosure, to create a 3 color heather yarn, 3 different colors of cationic dyed polyester filaments can be fed through the air texturizing machine in the same manner as discussed above in connection with the two color yarns. Again, the filaments used to create the twisted heather filament yarns may all be same yarn size, or may have different yarn sizes in order to create different and desired color effects and/or patterns.

The heather yarns produced by methods according to embodiments of the present disclosure may include two or more colors, or three or more colors, which is not achievable by the conventional methods. Indeed, the conventional methods can only produce heather fabrics having at most two colors, i.e., the color taken up by the cationic dyeable filaments, and the color taken up by the normal polyester filaments in the disperse dye bath. In contrast, there is theoretically no limit to the number of colors that can be used to create heather yarns according to embodiments of the present disclosure. Indeed, the number of filaments that can be used to create the twisted heather yarns is not particularly limited, and can be any number so long as the resulting twisted heather yarn satisfies the yarn size requirements of the intended end use of the twisted heather yarn.

The heather yarns according to embodiments of the present disclosure are also substantially bleed-free, i.e., they exhibit little to no bleeding due to the use of filaments dyed with cationic dyestuffs, neither of which sublimates under high temperature conditions during normal screen printing processes. Accordingly, the heather yarns according to embodiments of the present disclosure are ideal for making fabrics suitable for screen printing.

In some embodiments of the disclosure, a knitted heather fabric includes a plurality of the twisted heather yarns knitted together to form the knitted heather fabric. Because the filaments used to form the twisted heather yarns are all polyester, the knitted heather fabric may be 100% polyester. Additionally, as all the filaments used to form the twisted heater yarns can be cationic dyeable polyester filaments, the knitted heather fabric may be 100% cationic dyeable polyester, a fabric and heather color effect combination that is not achievable using the conventional heather dyeing process. In some embodiments, however, the twisted heather yarns disclosed herein can be combined with other materials (e.g., Spandex) to form the knitted heather fabric. According to some embodiments, to create a heather effect with more than two colors, a knitted heather fabric may include a plurality of the twisted heather yarns having first, second and/or third (or more) pre-colored filaments knitted together to form the knitted heather fabric, or may include a plurality of such yarns in addition to Spandex yarns knitted together to form the knitted heather fabric.

Referring back to FIG. 2, to produce knitted fabrics (203) of a desired construction, the twisted heather yarns may be fed into either a weft or warp knit machine in the form of bobbin or warp beams for knitting. Spandex yarns can also be incorporated into the fabric during the knitting process to give the knitted fabric higher elongation and good recovery properties. Once the knitting is finished, the fabric may go through a rinsing process (204) to remove contaminants and oil that may have been obtained during the twisting and knitting processes. After this rinsing, the fabric may be heat set to stabilize its dimensions and physical properties (205). During the heat setting process, additional chemical agents can be padded onto the fabric to achieve a desired function or performance characteristic. Non-limiting examples of such chemical agents include wicking agents, soil release agents, anti-static agents, anti-odor agents, anti-microbial agents, ultra-violet protection agents, cooling agents, water repellant agents, etc. to achieve specific desirable functional performance.

After the heat setting process, the knitted fabric is completed. Since cationic dyestuffs form strong ionic bonds with the dyeable cationic polyester materials of the filaments, the finished fabric has superb colorfastness. For example, in some embodiments, color fastness to dry heat (AATCC 117), color fastness to washing (AATCC 61-2A) and color fastness to dye transfer (AATCC 160) of the fabrics all achieve a grade of 4.5 or above.

According to some embodiments, the heather knitted fabric may be used to make articles of clothing or apparel. Those of ordinary skill in the art would be readily capable of using the heather fabrics disclosed herein to make articles of clothing or apparel. In some embodiments, when the heather fabrics disclosed herein are made into articles of clothing or apparel that require screen printing (such as, for example, a tee shirt), the shirt will go through printing, flashing & curing (common steps in screen printing an article of clothing). First, the shirt may be put onto a printing board where it may be affixed and screen printed either by a hand squeegee or an automatic squeegee. Once the article is printed with a plastisol ink, the shirt is placed under a flash dryer (i.e., a high wattage output infrared device that helps to quickly solidify the ink within seconds with high heat). The temperature needed to cure most plastisol inks on polyester articles of clothing (e.g., polyester tee shirts) is usually around 300° F. to 320° F., and the article of clothing is typically exposed to that heat for about 5 to a maximum of 10 seconds. If the print design has two colors, the tee may need to be printed and flashed a second time. If the print design has more than two colors, the tee may need to be printed and flashed an additional time for each additional color (e.g., a three-color print design may need three printing and flashing procedures, etc.). After the last flash, the shirt is removed from the printing board and placed on a conveyor belt of an infrared curing machine with the printed side facing upward. The shirt will then go through an enclosed infrared heating chamber for around 1 minute to completely cure the plastisol ink on the fabric. The temperature of the infrared heating chamber is typically set between 320° F. to a maximum of 340° F. for polyester articles of clothing or apparel (e.g., tee shirts).

Since the fabrics according to embodiments of the present disclosure include cationic dyeable polyester filaments dyed with cationic dyestuffs, the strong ionic bond formed between the cationic dyestuff molecules and the filaments generally do not break up when exposed to the flashing and curing temperatures experienced during screen printing. Thus, little to no dye migration occurs during screen printing. As a result, according to embodiments of the present disclosure, the heather fabric can achieve a grade of 4.5 on the color fastness to dry heat test (AATCC 117). Accordingly, the heather fabrics according to embodiments of the present disclosure are "bleed-free." As used herein, the term "bleed-free" refers to the color fastness of the heather fabrics achieving a grade of 4.5 or better on the color fastness to dry heat test (AATCC 117). In contrast, in articles of clothing (e.g., tee shirts) made with heather fabrics currently available on the market (e.g., those made by combining cationic dyeable polyester filaments and normal polyester filaments, and dyed after knitting), the disperse dyestuffs sublimate during the flashing and curing procedures of the screen printing process. As such, those conventional fabrics are undesirable for screen printing.

In sum, as shown in FIGS. 1 and 2, a process of making a twisted heather filament polyester yarn according to embodiments of the present disclosure includes dyeing high $SO_3^-$ content cationic dyeable polyester filaments with cationic dyestuffs using a filament bath dye method to make first, second and/or third (or more) pre-colored filament(s) (201). The first and second (and/or third or more) filament(s) are then twisted to create heather yarns of two or more colors (202). The twisted heather filament yarn is then knitted to form a kitted heather fabric (203). The knitted heather fabric may then be rinsed and de-oiled (204), and then heat set using chemical agents to complete the finished heather fabric (205). The completed heather fabric can then be formed into an article of clothing, and screen printed (if desired).

While certain exemplary embodiments of the present disclosure have been illustrated and described, those of ordinary skill in the art will recognize that various changes and modifications can be made to the described embodiments without departing from the spirit and scope of the present disclosure, and equivalents thereof, as defined in the claims that follow this description. For example, although certain components may have been described in the singular, i.e., "a" chemical agent, and the like, one or more of these components in any combination can be used according to the present disclosure.

Also, although certain embodiments have been described as "comprising" or "including" the specified components, embodiments "consisting essentially of" or "consisting of" the listed components are also within the scope of this disclosure. For example, while embodiments of the present invention are described as including a combination of first and second pre-colored filaments, a heather filament polyester yarn consisting essentially of or consisting of first and second pre-colored filaments is also within the scope of this disclosure. Accordingly, the heather polyester filament yarn may consist essentially of the first and second pre-colored filaments. In this context, "consisting essentially of" means that any additional components in the heather polyester filament yarn will not materially affect the ability of the ability of the filaments to be twisted into the yarn, or the ability of the yarn to be knitted into a fabric or textile.

As used herein, unless otherwise expressly specified, all numbers such as those expressing values, ranges, amounts or percentages may be read as if prefaced by the word "about," even if the term does not expressly appear. Further, the word "about" is used as a term of approximation, and not as a term of degree, and reflects the penumbra of variation associated with measurement, significant figures, and interchangeability, all as understood by a person having ordinary skill in the art to which this disclosure pertains. Any numerical range recited herein is intended to include all sub-ranges subsumed therein. Plural encompasses singular and vice versa. For example, while the present disclosure describes "a" chemical agent, a mixture of such chemical agents can be used. When ranges are given, any endpoints of those ranges and/or numbers within those ranges can be combined within the scope of the present disclosure. The terms "including" and like terms mean "including but not limited to," unless specified to the contrary.

Notwithstanding that the numerical ranges and parameters set forth herein may be approximations, any numerical value inherently contains certain errors necessarily resulting from the standard variation found in their respective testing measurements. The word "comprising" and variations thereof as used in this description and in the claims do not limit the disclosure to exclude any variants or additions.

What is claimed is:

1. A heather filament yarn, comprising:

first pre-colored filaments comprising first precursor polyester filaments dyed with a first cationic dyestuff having a first color, the first precursor polyester filaments having at least 2.3% $SO_3^-$ content by weight, and second pre-colored filaments comprising second precursor polyester filaments separately dyed with a second cationic dyestuff having a second color that is different from the first color, the second precursor polyester filaments having at least 2.3% $SO_3^-$ content by weight, the first and second pre-colored filaments being twisted together to form the heather filament yarn, wherein the first and second pre-colored filaments generally do not sublime when the heather filament yarn is subjected to temperatures ranging between 300 degrees and 340 degrees Fahrenheit, and the heather filament yarn achieves grade 4.5 or better in one or more of color fastness to dry heat, color fastness to washing, and color fastness to dye transfer.

2. The heather filament yarn of claim 1, further comprising third pre-colored filaments comprising third precursor polyester filaments that are dyed with a third cationic dyestuff having a third color that is different from the first color and the second color, the third precursor polyester filaments having at least 2.3% $SO_3^-$ content by weight, wherein the third pre-colored filaments are twisted together with the first and second pre-colored filaments to form the heather filament yarn.

3. A knitted heather fabric comprising a plurality of the heather filament yarns according to claim 1 knitted together to form the knitted heather fabric.

4. The knitted heather fabric of claim 3, wherein the knitted heather fabric is 100% polyester.

5. A knitted heather fabric comprising a plurality of the heather filament yarns according to claim 2 knitted together to form the knitted heather fabric.

6. A knitted heather fabric comprising a plurality of the heather filament yarns according to claim 1 and at least one Spandex yarn knitted together to form the knitted heather fabric.

7. A knitted heather fabric comprising a plurality of the heather filament yarns according to claim 2 and at least one Spandex yarn knitted together to form the knitted heather fabric.

8. The heather filament yarn according to claim 1, wherein the first color of the first pre-colored filaments is contrasting to the second color of the second pre-colored filaments.

9. The heather filament yarn according to claim 1, wherein the first color of the first pre-colored filaments is a different tone, shade or tint of the second color of the second pre-colored filaments.

10. An article of clothing, comprising the knitted heather fabric of claim 3.

11. The article of clothing according to claim 10, wherein the first color of the first pre-colored filaments is contrasting to the second color of the second pre-colored filaments.

12. The article of clothing according to claim 10, wherein the first color of the first pre-colored filaments is a different tone, shade or tint of the second color of the second pre-colored filaments.

13. An article of clothing, comprising the knitted heather fabric of claim 5.

14. A method of manufacturing the heather filament yarn of claim 1, the method comprising:

preparing a plurality of the first pre-colored filaments by dyeing the first precursor filaments using the first cationic dyestuff;

preparing a plurality of the second pre-colored filaments by dyeing the second precursor filaments using the second cationic dyestuff; and twisting the plurality of first pre-colored filaments together with the plurality of second pre-colored filaments to form the heather filament yarn.

15. The method according to claim 14, further comprising:

separately preparing a plurality of third pre-colored filaments by dyeing third precursor filaments using a third cationic dyestuff having a third color that is different from the first color and the second color, wherein the twisting comprises twisting the first pre-colored filaments and the second pre-colored filaments with the third pre-colored filaments.

16. The method according to claim 14, wherein the dyeing the plurality of first pre-colored filaments and the separately dyeing the plurality of second pre-colored filaments each comprises:

combining a plurality of the first or second precursor polyester filaments with water to form a filament bath;

adding the first or second cationic dyestuff to the filament bath to form a dye bath;

heating the dye bath to facilitate dyeing; and removing the water from the dye bath to yield the plurality of first pre-colored filaments or the plurality of second pre-colored filaments.

17. The method according to claim 14, wherein the first color of the first pre-colored filaments is contrasting to the second color of the second pre-colored filaments.

18. The method according to claim 14, wherein the first color of the first pre-colored filaments is a different tone, shade or tint of the second color of the second pre-colored filaments.

19. A method of making a knitted heather fabric, the method comprising:

preparing a plurality of heather filament yarns according to the method of claim 14; and knitting the plurality of heather filament yarns together to form the knitted heather fabric.

20. A method of making a knitted heather fabric, the method comprising:

preparing a plurality of heather filament yarns according to the method of claim 15; and knitting the plurality of heather filament yarns together to form the knitted heather fabric.

21. The heather filament yarn according to claim 1, wherein the first and second precursor polyester filaments prior to dyeing are the same.

* * * * *